US007810803B2

(12) United States Patent
Hoberock et al.

(10) Patent No.: US 7,810,803 B2
(45) Date of Patent: Oct. 12, 2010

(54) SHEET CONSTRAINT

(75) Inventors: Tim M. Hoberock, Vancouver, WA (US); David F. D. Buck, Vancouver, WA (US); Samrin Sing, Vanvouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 156 days.

(21) Appl. No.: 11/805,810

(22) Filed: May 24, 2007

(65) Prior Publication Data

US 2008/0290588 A1 Nov. 27, 2008

(51) Int. Cl.
*B65H 3/52* (2006.01)

(52) U.S. Cl. ..... 271/124; 271/117; 271/121

(58) Field of Classification Search ..... 271/124, 271/121, 117, 104, 167, 137
See application file for complete search history.

(56) References Cited

U.S. PATENT DOCUMENTS 2,995,366 A 8/1960 Maidment
4,403,899 A * 9/1983 Lampe et al. ..... 414/788.9
4,456,235 A 6/1984 Colglazier et al.
5,090,682 A 2/1992 Takimoto
5,431,385 A * 7/1995 Holbrook ..... 271/122
5,863,036 A * 1/1999 Tanaka et al. ..... 271/10.11
6,296,244 B1 10/2001 Hanks et al.
6,375,183 B1 * 4/2002 Inoue et al. ..... 271/10.11
6,502,816 B2 * 1/2003 Inoue et al. ..... 271/121
6,893,014 B2 5/2005 Baker et al.
6,966,711 B2 * 11/2005 Miller et al. ..... 400/55
2006/0023358 A1 2/2006 Huang

FOREIGN PATENT DOCUMENTS

JP 2000053266 A * 2/2000

* cited by examiner

*Primary Examiner*—Patrick Mackey
*Assistant Examiner*—Ernesto Suarez

(57) ABSTRACT

An apparatus in an example comprises a sheet holder, a separator surface, a feed head, and one or more arms. The sheet holder supports one or more sheets of media. The separator surface receives a leading edge of a sheet of the one or more sheets of media. The feed head is selectively positionable against a face of the sheet. The one or more arms extend toward an intermediate location of the separator surface to constrain the sheet from movement away from the separator surface.

20 Claims, 5 Drawing Sheets

SHEET CONSTRAINT

BACKGROUND

Printer sheet feeding mechanisms often have an intake portion, in which paper or other sheet media is received, and an output portion, in which the sheet media is expelled after processing. In some applications, the input portion retrieves one sheet at a time from a stack of sheets. The handling of the sheet media in the exit path serves to promote control of the movement of the media and decrease occurrence of media jams. In the inlet path, media jams may occur when picking individual sheets from a stack.

DESCRIPTION OF THE DRAWINGS

Features of exemplary embodiments will become apparent from the description, the claims, and the accompanying drawings in which:

DETAILED DESCRIPTION

Referring to the BACKGROUND section above, with the increasingly widespread reliance on computers to generate and scan printed media of all types, it is desirable that paper and other types of sheet media can be reliably conveyed into media handling devices, such as laser printers, ink jet printers, copiers, scanners and fax machines. In order to accomplish this task, a variety of sheet feeding mechanisms can be employed.

The imparting of a curved, or wave-shaped, cross-section on the sheet media serves to increase the sheet beam stiffness, thus inhibiting paper jams and misfeeds that might otherwise be caused by unconstrained movement of the leading edge of the sheet. Sufficient constraint of movement of the sheet media serves to prevent media jams, for example, when individual sheets are picked from a stack in the inlet media path.

In the intake portion of the paper feed path, sheet media may be conveyed along unintended paths as it is separated from adjacent sheets of media and conveyed towards a nip or other media transport mechanism. Such undesired movement may be caused or exacerbated by factors such as the physical characteristics of the media, buildup of static charge on the surface of the media, or physical deformities of the media such as folds, frayed edges or curling. In some scenarios, unexpected media movement can cause jamming of the media feed arrangement. Such jams may need expensive or time consuming repair, negatively impact the user's productivity, and result in frustration or dissatisfaction to the user.

One such jam that can occur in connection with some sheet media feeding mechanisms can be described as a "foldback jam." A foldback jam can occur when a sheet of media curls and/or folds back in the direction generally away from the intended feed path. If such foldback jams take place within internal portions of a paperhandling device, they can be particularly difficult for untrained users to identify and correct.

Figure 1:
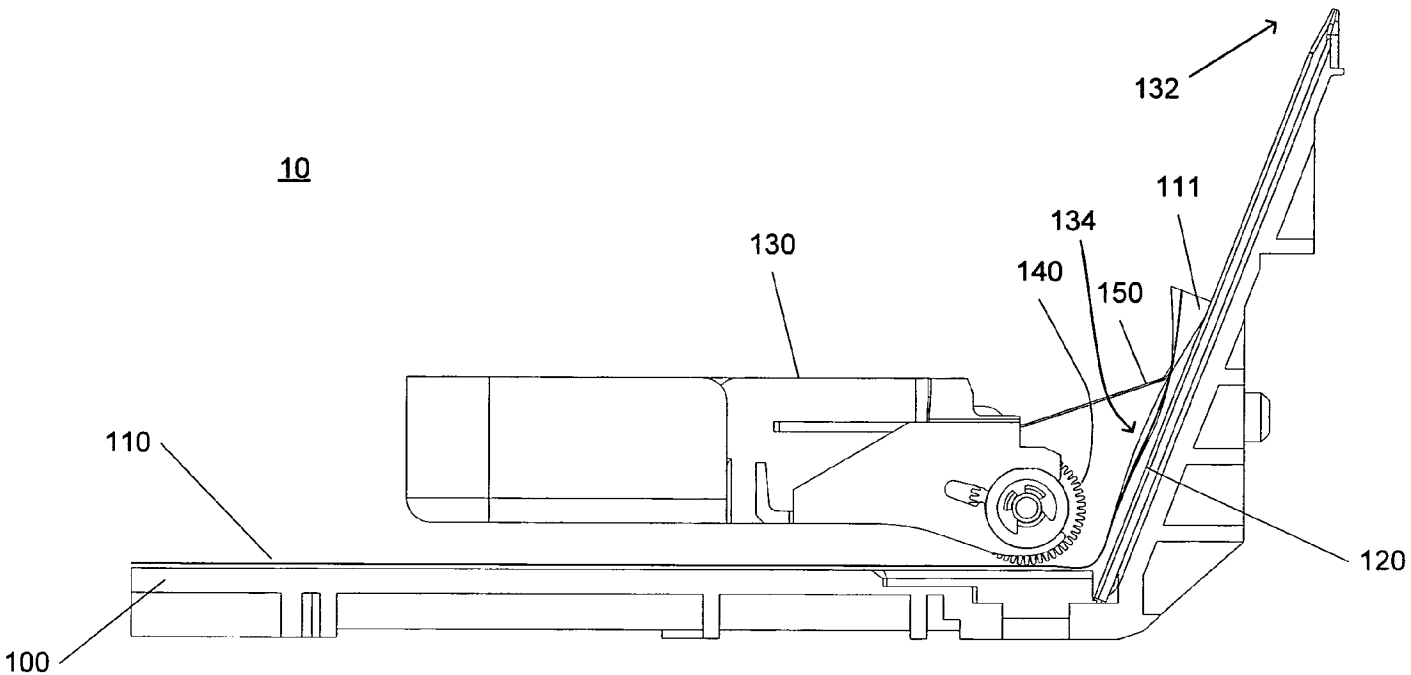
FIG. 1 is a side elevation representation of an embodiment of an apparatus that comprises a sheet holder, a separator surface, and a feed head.
Figure 5:
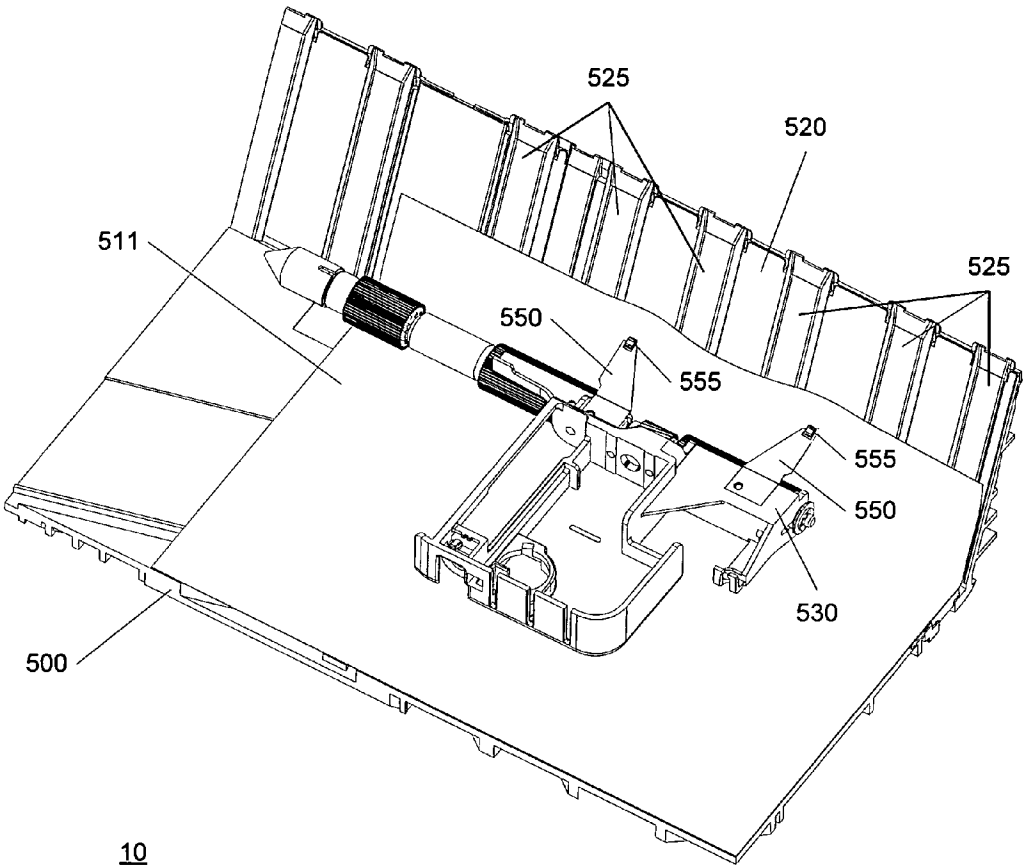
FIG. 5 is a perspective representation of another embodiment of the apparatus of FIG. 1, and illustrates guide arms having rollers that facilitate movement of a sheet along the separator surface.

An exemplary embodiment operates to feed a sheet along a feed path, while controlling movement of the sheet along the desired path. Guide arms can operate to constrain the sheet movement along an inclined surface. A wave shape can be imposed on the cross-section of the sheet to further control movement of the sheet Turning to FIGS. 1, 2, 3, and 5, an embodiment of an apparatus 10 in an example comprises a sheet holder 100 (FIGS. 1 and 2), 300 (FIG. 3), 500 (FIG. 5), a separator surface 120 (FIGS. 1 and 2), 320 (FIG. 3), 520 (FIG. 5), a feed head 130 (FIGS. 1 and 2), 530 (FIG. 5), and one or more arms 150 (FIG. 1 and 2), 550 (FIG. 5). FIG. 1 is a side elevation of an exemplary embodiment of the sheet holder 100, which embodiment is illustrated in perspective view in FIG. 2. The sheet feed holder 100 provides a surface against which one or more pieces of sheet media 110 can be stacked. The sheet media 110 in an example comprises any of a variety of types of media. In typical printer, fax or scanner applications, sheet media 110 in an example comprises standard copier paper, photo paper, rag stock, plastic transparency film, or other types of media.

The sheet media 110 in an example is initially stacked such that the leading edge of each page is directed towards separator surface 120. The separator surface 120 in an example comprises a ramp wall that is inclined relative to sheet holder 100. Separator surface 120 further comprises a plurality of separator strips 125 (FIG. 2), 525 (FIG. 5). Separator strips 125 in an example comprise ridges that are raised relative to the plane of separator surface 120, providing a non-uniform surface against which the leading edge of sheet 111 can be urged. In another example, the separator surface 120 and/or separator strips 125 can be fabricated using structures that further promote separation of a top sheet from a plurality of sheets. For example, the separator surface 120 and/or separator strips 125 can be fabricated from a material having a low coefficient of friction, or coated with a low-friction coating, to facilitate movement of sheet 111 over the surfaces. Separator strips 125 can also be fabricated having irregular surfaces, such as serrations like saw teeth or fish scales, to restrain the leading edge of the media as the media is advanced towards the separator strip, until a buckle forms in the top sheet. In such an embodiment, the spring force in the buckled media eventually grows strong enough to pop the media sheet out of the serration, such that the freed top sheet is fed up the separator surface.

In some high volume applications, it is possible that separator strips 125 will be subjected to substantial wear, for example, due to repeated sliding friction imposed by the movement of sheet media over the strips. Such wear may be particularly significant and/or challenging where separator strips 125 are coated with a low-friction coating. In some embodiments, separator strips 125 may be removable; for example, such that the separator strips 125 can be periodically replaced by service personnel.

Feed head 130 acts to engage the face of sheet 111. The feed head 130 in an example comprises roller wheels 140. Feed head 130 is selectively positionable such that roller wheels 140 engage the face of sheet 111, and rotate against sheet 111, thereby urging sheet 111 towards separator surface 120. The arrangement of separator surface 120 acts to promote the separation of sheet 111 from other sheets in stack 110, such that sheet 111 is singly fed up the face of separator surface 120, and into a nip (not shown) or other media transport mechanism such as into a sheet transport printer path 132 (FIGS. 1 and 3), as will be appreciated by those skilled in the art.

Figure 2:
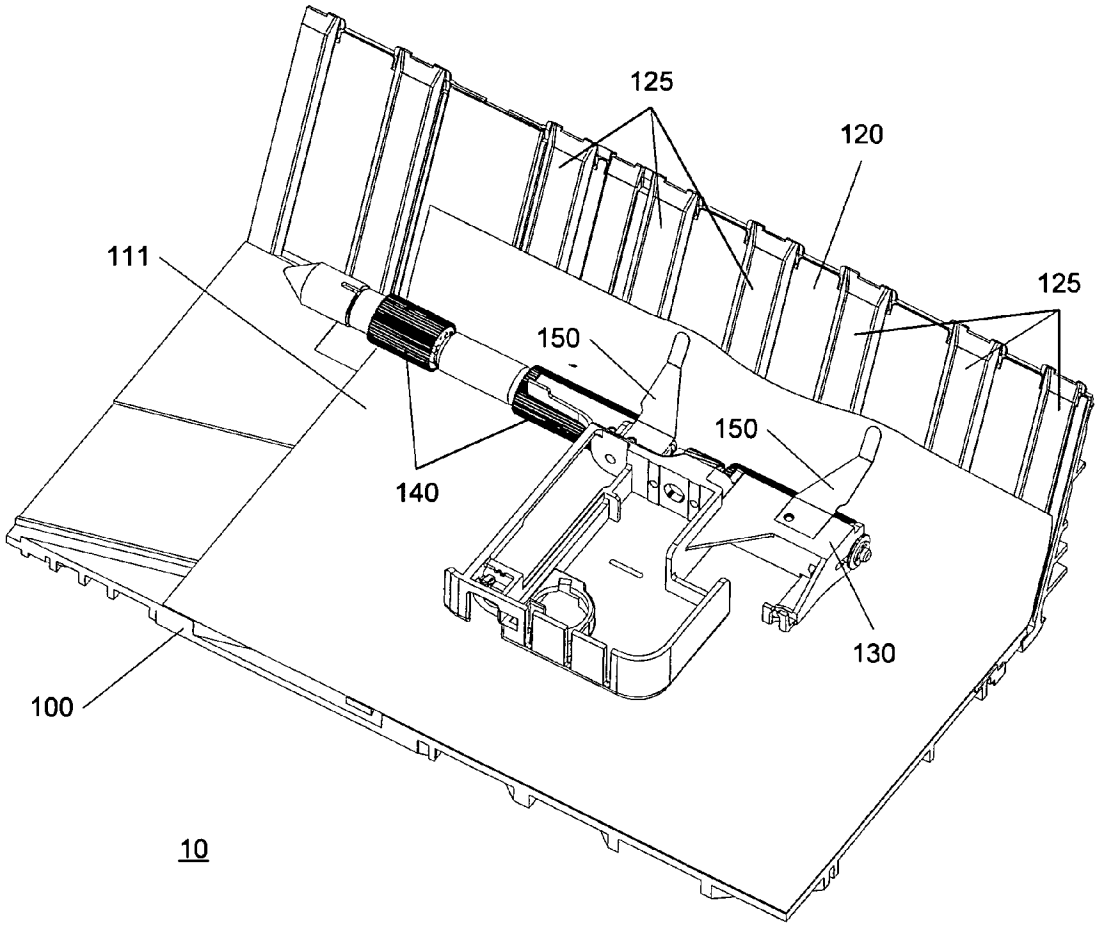
FIG. 2 is a perspective representation of an embodiment of the apparatus of FIG. 1, and illustrates one or more guide arms.
Figure 3:
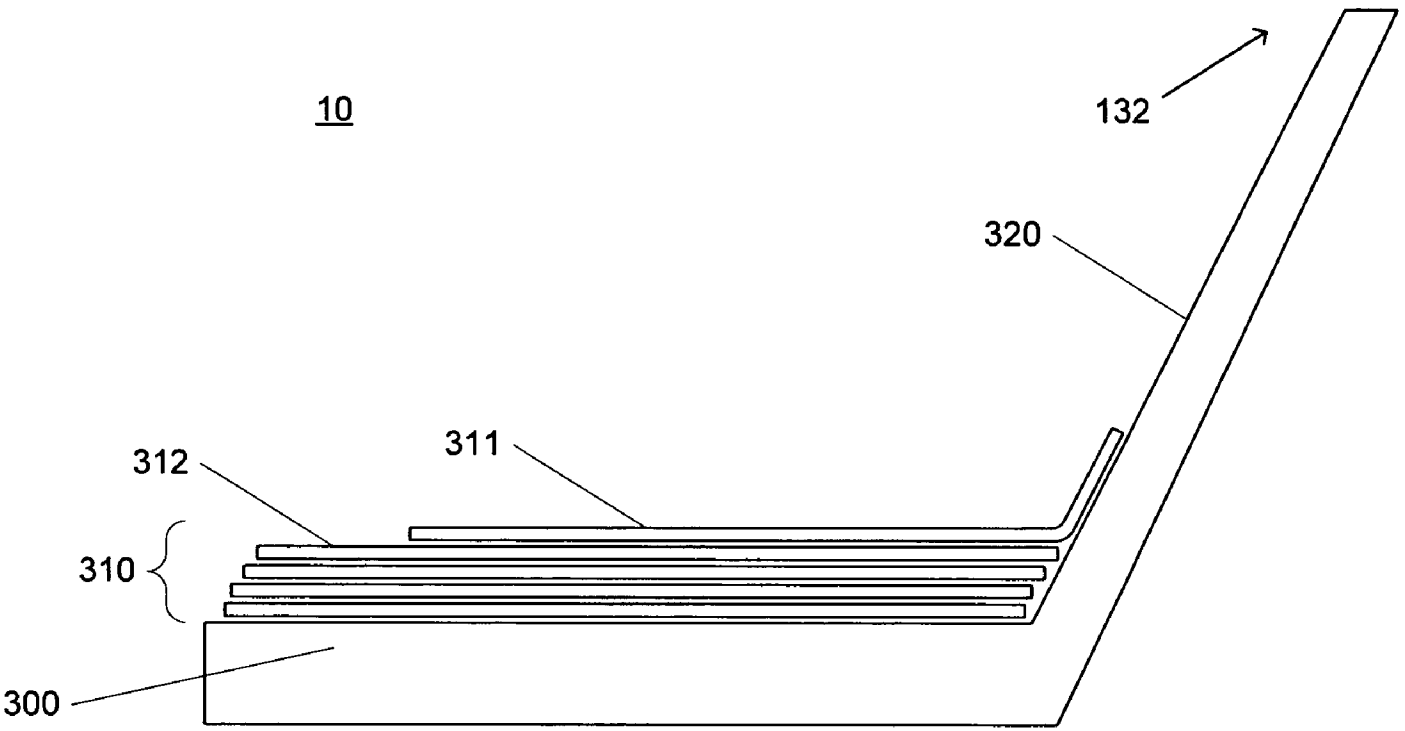
FIG. 3 is a schematic side elevation representation of sheet media interacting with the separation surface of an embodiment of the apparatus of FIG. 1.

A schematic illustration of an exemplary operation of a separator surface such as separator surface 120 is provided in FIG. 3. Sheet stack 310 in an example comprises a plurality of sheets of sheet media, stacked on sheet holder 300, having leading edges generally facing towards separator surface 320. A feed head 130 (FIGS. 1 and 2) engages a sheet 311 as the top sheet in the sheet stack 310, and urges the sheet 311 in the direction of separator surface 320, such that sheet 311 singly travels up the face of surface 320, leaving the remainder of sheet media 310 behind on sheet holder 300. Once sheet 311 is removed from stack 310 and conveyed up surface 320 and into a subsequent feed path, the feed head 130 can disengage from sheet 311 and subsequently engage sheet 312 as the next sheet on the sheet stack 310, at which point the sheet 312 can be conveyed up the face of separator surface 320.

Referring to FIGS. 1 and 2, the guide arms 150 in an example are attached at one end to feed head 130. Guide arms 150 extend towards separator surface 120, and in some embodiments, are adjacent to surface 120, such that they undergo physical contact with separator surface 120 when a sheet of media is not positioned on the face of surface 120. In particular, as feed head 130 acts to urge sheet 111 up the face of separator surface 120, guide arms 150 act to constrain the movement of sheet 111. In so doing, guide arms 150 prevent the leading edge of sheet 111 from curling back over the top of feed arm 130, or excessively peeling away from the separator surface 120, such that the leading edge of sheet 111 is fed smoothly into the tray exit funnel and/or feed transport rollers. For example, the guide arms 150 constrain movement of a leading edge and an intermediate expanse 134 of the selected sheet against the face of separator surface 120.

Figure 4:
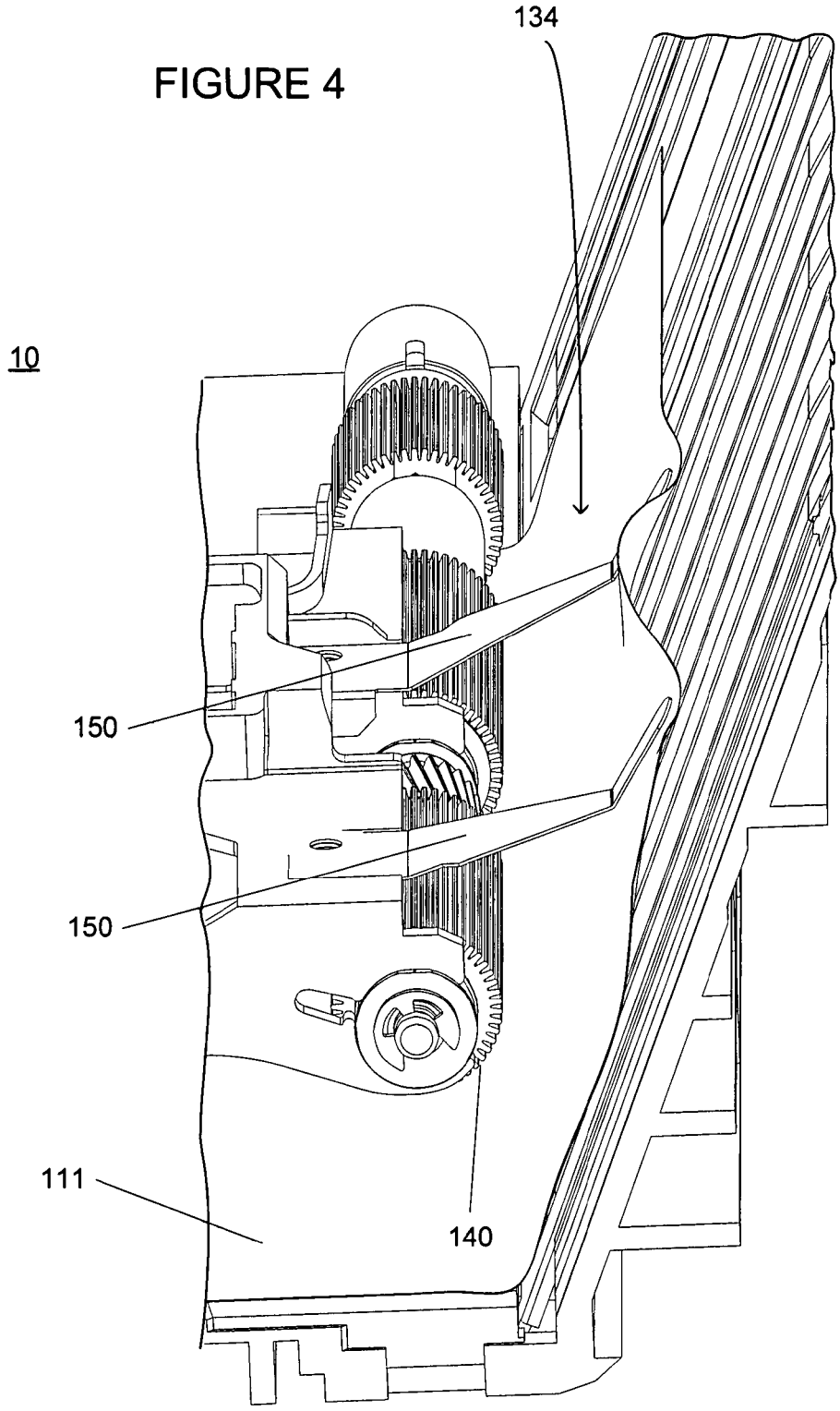
FIG. 4 is a partial perspective representation of an embodiment of the apparatus of FIG. 1, and illustrates guide arms in contact with sheet media located on the separator surface.

In some embodiments, the guide arms 150 may be positioned such that they contact separator surface 120 at a position between raised separator strips 125. The sheet 111 in an example is typically and/or normally flat and fed up separator surface 120 to contact the guide arms 150. The guide arms 150 in an example act to force portions of sheet 111 back against separator surface 120, while adjacent portions of sheet 111 are elevated by contact with separator strips 125. The interaction of guide arms 150 and neighboring separator strips 125 on sheet 111 in an example acts and/or serves to impart a wave-shaped cross-section to sheet 111. The resulting wave cross-section can act to increase the beam stiffness of sheet 111, thereby promoting control of the movement of sheet 111, and inhibition of foldback of sheet 111 in a direction other than an intended direction of travel for the sheet 111. FIG. 4 provides a different perspective view of the embodiment illustrated in FIGS. 1 and 2, further illustrates an exemplary wave shape imparted on sheet 111 by guide arms 150 and separator strips 125.

Referring to FIGS. 1, 2 and 4, guide arms 150 in an example comprise antifoldback foils, for example, formed from flexible metal that is, for example, 0.25 mm in thickness. In another example, the guide arms 150 could be formed with different dimensions, or from other materials, such as biaxially-oriented polyethylene terephthalate (boPET) polyester film, for example, offered under the trade name Mylar, glass-filled ABS (acrylonitrile butadiene styrene) plastic, or cantilevered metal wire. An exemplary embodiment employs two guide arms as the guide arms 150. In another exemplary embodiment, an additional, other, and/or arbitrary number of guide arms as the guide arms 150 can be employed. Embodiments can employ guide arms 150 having different shapes, for example, forked guide arms that comprise a plurality of fingers extending from a common mounting base.

The guide arms 150 in an example extend towards portions of separator surface 120 that are between separator strips 125. In another example, the guide arms 150 may extend towards the top surface of separator strips 125. The guide arms 150 in an example can inhibit foldback of sheet media and may or may not act to impart a wave shape on the sheet 111. In a further example, the separator surface 120 may be formed from structures such as a flat inclined surface, for example, that omits separator strips 125. A guide arm 150 in an example may be mounted to a feed head 130, and configured to extend upwards, generally in the direction of the edge of the separator surface 120 furthest from the sheet holder 100. An exemplary embodiment may fix one end of the guide arms 150 on the feed head 130, while attaching the other end of the guide arms 150 at another location, such as a location near the furthest edge of the separator surface 120 or near the nip (not shown) such as at an inlet and/or entrance to the sheet transport printer path 132 (FIGS. 1 and 3), as will be appreciated by those skilled in the art. Roll-up or coiled guide arm structures as the guide arms 150 in an example can be employed to accommodate movement of the feed head 130 relative to the remote attachment point.

FIG. 5 illustrates a perspective view of an exemplary embodiment of the apparatus 10 that incorporates guide arms 550 with roller wheels 555. The sheet media 511 in an example is supported by sheet holder 500. Feed head 530 acts to move sheet 511 towards separator surface 520 and separator strips 525. As sheet 511 moves up separator surface 520, its movement is constrained by guide arms 550 through contact with roller wheels 555, mounted on the ends of guide arms 550. Roller wheels 555 in an example act to facilitate movement of sheet 511, for example, by reducing or eliminating sliding friction between guide arms 550 and sheet 511, and substituting a reduced, rolling friction. When oriented between separator strips 525 in an example roller wheels 555 can further act to impart a wave-shaped cross-section on sheet 511, for example, to increase the beam stiffness of sheet 511 and further controlling movement of the sheet 511.

An exemplary embodiment comprises a sheet holder 100, a separator surface 120, a feed head 130, and one or more arms 150. The sheet holder 100 supports one or more sheets of media 110. The separator surface 120 receives a leading edge of a sheet 111 of the one or more sheets of media 110. The feed head 130 is selectively positionable against a face of the sheet 111. The one or more arms 150 extend toward an intermediate location of the separator surface 120 to constrain the sheet 111 from movement away from the separator surface 120.

Each of the one or more arms 150 connects to the feed head 130. A first end of each of the one or more arms 150 is adjacent to the separator surface 120. A second end of each of the one or more arms 150 is adjacent to the separator surface 120.

The separator surface 120 comprises one or more separator strips 125, each of which is raised relative to surrounding portions of the separator surface 120. The one or more arms 150 extend towards portions of the separator surface 120 other than the separator strips 125. The separator strips 125 are removable from the separator surface 120 and replaceable.

Each of the one or more arms 150 comprises a roller 555 that is attached proximate an end of the arm oriented towards the separator surface. Each of the one or more arms 150 comprises one or more of thin sheet metal, biaxially-oriented polyethylene terephthalate (boPET) polyester film, glass-filled ABS (acrylonitrile butadiene styrene) plastic, and/or cantilevered metal wire. Each of the one or more arms 150 is flexible.

An exemplary approach propels a sheet of media 111 along a surface 120 that is inclined relative to a sheet holder 100. Movement of the sheet 111 is constrained at an intermediate location of the surface 120 that is inclined relative to the sheet holder 100 by contact of the sheet 111 with one or more arms 150 that extend towards the surface 120 that is inclined relative to the sheet holder 100.

The sheet 111 is propelled along the surface 120 that is inclined relative to the sheet holder 100 through employment of a movable feed head 130. The sheet 111 is contacted at an intermediate location of the surface 120 that is inclined relative to the sheet holder 100 through employment of one or more arms 150, each with a first end that is attached to the movable feed head 130 and a second end that extends adjacent to the surface 120 that is inclined relative to the sheet holder.

An embodiment of the apparatus 10 in an example comprises a plurality of components such as one or more of electronic components, chemical components, organic components, mechanical components, hardware components, optical components, and/or computer software components. A number of such components can be combined or divided in an embodiment of the apparatus. 10. In one or more exemplary embodiments, one or more features described herein in connection with one or more components and/or one or more parts thereof are applicable and/or extendible analogously to one or more other instances of the particular component and/or other components in the apparatus 10. In one or more exemplary embodiments, one or more features described herein in connection with one or more components and/or one or more parts thereof may be omitted from or modified in one or more other instances of the particular component and/or other components in the apparatus 10. An exemplary technical effect is one or more exemplary and/or desirable functions, approaches, and/or procedures. An exemplary component of an embodiment of the apparatus 10 employs and/or comprises a set and/or series of computer instructions written in or implemented with any of a number of programming languages, as will be appreciated by those skilled in the art. An embodiment of the apparatus 10 in an example comprises any (e.g., horizontal, oblique, angled, or vertical) orientation, with the description and figures herein illustrating an exemplary orientation of an exemplary embodiment of the apparatus 10, for explanatory purposes.

The steps or operations described herein are examples. There may be variations to these steps or operations without departing from the spirit of the invention. For example, the steps may be performed in a differing order, or steps may be added, deleted, or modified.

Although exemplary embodiments of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

What is claimed is:

1. An apparatus, comprising:

a sheet holder that is to support one or more sheets of media;

a separator that receives a leading edge of a sheet of the one or more sheets of media, the separator including a separator surface and raised separator strips that extend away from the separator surface, the separator strips defining a gap between them;

a feed head that is selectively positionable against a face of the sheet; and a guide arm that extends toward the separator at a location along the separator surface that is above the feed head to constrain the sheet from moving away from the separator, the guide arm having a distal tip that is positioned within the gap defined by the separator strips.

2. The apparatus of claim 1, wherein the guide arm is mounted to the feed head.

3. The apparatus of claim 1, wherein the distal tip of the guide arm contacts the separator surface between the separator strips when the sheet is not positioned between the guide arm and the separator.

4. The apparatus of claim 1, wherein the separator strips are removable from the separator surface and replaceable.

5. The apparatus of claim 1, wherein the guide arm comprises a roller that is mounted to the distal tip of the guide arm.

6. The apparatus of claim 1, wherein the guide arm comprises one or more of thin sheet metal, biaxially-oriented polyethylene terephthalate (boPET) polyester film, glass-filled ABS (acrylonitrile butadiene styrene) plastic, and/or cantilevered metal wire.

7. The apparatus of claim 1, wherein the guide arm is flexible.

8. A method, comprising:

propelling a sheet of media via a sheet feeding mechanism along a separator that is inclined relative to a sheet holder, the separator including a separator surface and raised separator strips that extend out from the separator surface, the separator strips defining a gap between them; and constraining movement of the sheet away from the separator surface by using a guide arm that extends toward the separator surface to urge the sheet into the gap between the separator strips at a location along the separator surface that is above the sheet feeding mechanism.

9. The method of claim 8, wherein propelling the sheet via the sheet feeding mechanism comprises propelling the sheet using a movable feed head and wherein constraining movement of the sheet comprises urging the sheet into the gap using a guide arm that is mounted to the movable feed head and that extends into the gap between the separator strips when the sheet is not positioned between the guide arm and the separator.

10. The method of claim 8, wherein constraining movement of the sheet comprises imparting a wave shape on a cross-section of the sheet with the guide arm and the separator strips.

11. The method of claim 8, further comprising mounting a roller at a distal tip of the guide arm and wherein the roller contacts the sheet during the constraining.

12. The method of claim 8, further comprising forming the guide arm to comprise one or more of thin sheet metal, biaxially-oriented polyethylene terephthalate (boPET) polyester film, glass-filled ABS (acrylonitrile butadiene styrene) plastic, and/or cantilevered metal wire.

13. A sheet feeding mechanism comprising:

a sheet holder adapted to support a stack of media sheets that are to be fed by the mechanism;

a separator positioned adjacent the sheet holder adapted to receive leading edges of the media sheets as the sheets are individually fed by the sheet feeding mechanism, the separator including an inclined surface and raised separator strips that extend out from the separator surface, the separator strips defining gaps between them;

a feed head that is selectively positionable against the stack of media sheets and that includes a roller wheel adapted to drive individual media sheets from the stack and toward the separator; and flexible guide arms mounted to a surface of the feed head that is above an axis of rotation of the roller wheel and extend from the feed head toward the separator, the guide arms including distal tips that are each positioned within a gap defined by the separator strips, the guide arms being adapted to constrain media sheets driven by the roller wheel such that the sheets are urged into the gaps and are made to adopt a wave-shaped cross-section that increases the beam stiffness of the sheet and thereby constrain the sheet from moving away from the separator surface and toward the feed head as the sheet advances along the separator.

14. The sheet feeding mechanism of claim 13, wherein the distal tips of the guide arms contact the separator surface between the separator strips when a media sheet is not positioned between the guide arms and the separator.

15. The sheet feeding mechanism of claim 13, wherein the guide arms have rollers rotatably mounted at their distal tips that engage the sheets as they are fed between the guide arms and the separator.

16. The apparatus of claim 13, wherein the guide arms extend toward the separator surface above an axis of the roller wheel.

17. A sheet feeding apparatus, comprising:

a separator adjacent a sheet holder, the separator having a separator surface that is inclined relative to the sheet holder and raised separator strips that extend from the separator surface to define a gap;

a feed mechanism adjacent a sheet tray of the sheet holder to advance a sheet from the sheet holder to the separator surface; and a guide arm that extends toward the separator surface above the feed mechanism such that a distal tip of the guide arm is positioned within the gap defined by the separator strips.

18. A sheet feed apparatus of claim 17, wherein the feed mechanism includes a roller wheel and the guide arm extends toward the separator surface above an axis of the roller wheel.

19. A sheet feed apparatus of claim 17, wherein the guide arm is to constrain the sheet from moving away from the separator surface and toward the feed mechanism when the sheet advances along the separator surface.

20. A sheet feed apparatus of claim 17, wherein the guide arm is to urge the sheet into the gap to impart a wave-shaped cross-section to the sheet to increases the beam stiffness of the sheet.

* * * * *